US008130985B2

(12) United States Patent
Emilsson

(10) Patent No.: US 8,130,985 B2
(45) Date of Patent: Mar. 6, 2012

(54) EAR CUP WITH BONE CONDUCTION MICROPHONE

(75) Inventor: Niklas Emilsson, Rydaholm (SE)

(73) Assignee: 3M Innovative Properties Company, St. Paul, MN (US)

( * ) Notice: Subject to any disclaimer, the term of this patent is extended or adjusted under 35 U.S.C. 154(b) by 583 days.

(21) Appl. No.: 12/303,497

(22) PCT Filed: Jun. 7, 2007

(86) PCT No.: PCT/SE2007/000544

§ 371 (c)(1),
(2), (4) Date: Dec. 4, 2008

(87) PCT Pub. No.: WO2008/013487

PCT Pub. Date: Jan. 31, 2008

(65) Prior Publication Data

US 2009/0252352 A1 Oct. 8, 2009

(30) Foreign Application Priority Data

Jun. 20, 2006 (SE) ..... 0601361

(51) Int. Cl.
*H04R 1/00* (2006.01)

(52) U.S. Cl. ..... 381/151; 381/380; 381/375

(58) Field of Classification Search ..... 381/151, 381/380, 72, 326, 370, 371, 374–379
See application file for complete search history.

(56) References Cited

U.S. PATENT DOCUMENTS

| | | | | |
|---|---|---|---|---|
| 3,087,028 | A * | 4/1963 | Bonnin | 379/430 |
| 3,306,991 | A | 2/1967 | Wood | |
| 3,394,226 | A | 7/1968 | Andrews, Jr. | |
| 3,529,102 | A | 9/1970 | Rosenstand | |
| 3,869,584 | A * | 3/1975 | Wilde | 379/430 |
| 3,890,474 | A | 6/1975 | Glicksberg | |
| 3,947,646 | A | 3/1976 | Saito | |
| 3,952,158 | A | 4/1976 | Kyle | |

(Continued)

FOREIGN PATENT DOCUMENTS

DE 10117704 9/2001

(Continued)

OTHER PUBLICATIONS

International Search Report PCT/SE2007/000544; Dated Sep. 24, 2007.

*Primary Examiner* — Ha Tran T Nguyen
*Assistant Examiner* — Jordan Klein
(74) *Attorney, Agent, or Firm* — Emily M. Van Vilet

(57) ABSTRACT

An ear cup with a bone conduction function comprising a cup (1), a sealing ring (3) and a microphone capsule (5). The cup (1) has an edge (2) on which the sealing ring (3) is disposed. The microphone capsule (5) is disposed in a retainer body (4). The retainer body (4) has an anchorage portion (6) with which the retainer body (4) and its anchorage portion (6) are secured interiorly in the cup. The retainer body (4) has a substantially planar surface for abutment and sealing against the wearer's head in the position of use. In the position of use, the retainer body (4) is located between the sealing ring (3) and the wearer's head, and the retainer body (4) is wholly or partly pressed into the sealing ring (3).

7 Claims, 2 Drawing Sheets

U.S. PATENT DOCUMENTS

| | | | | | |
|---|---|---|---|---|---|
| 4,025,734 | A | * | 5/1977 | Aloupis | 381/151 |
| 4,064,362 | A | | 12/1977 | Williams | |
| 4,087,653 | A | * | 5/1978 | Frieder et al. | 379/430 |
| 4,088,849 | A | * | 5/1978 | Usami et al. | 379/430 |
| 4,150,262 | A | * | 4/1979 | Ono | 381/326 |
| 4,302,635 | A | * | 11/1981 | Jacobsen et al. | 381/371 |
| 4,455,675 | A | * | 6/1984 | Bose et al. | 381/74 |
| 4,588,868 | A | * | 5/1986 | Bertagna et al. | 381/382 |
| 4,644,581 | A | * | 2/1987 | Sapiejewski | 381/74 |
| 4,833,719 | A | * | 5/1989 | Carme et al. | 381/72 |
| 4,867,149 | A | | 9/1989 | Falco | |
| 4,887,693 | A | | 12/1989 | Plice | |
| 4,928,311 | A | | 5/1990 | Trompler | |
| 4,985,925 | A | | 1/1991 | Langberg | |
| 5,125,032 | A | * | 6/1992 | Meister et al. | 381/72 |
| 5,251,263 | A | | 10/1993 | Andrea | |
| 5,404,577 | A | * | 4/1995 | Zuckerman et al. | 455/66.1 |
| 5,450,496 | A | * | 9/1995 | Burris et al. | 381/375 |
| 5,550,923 | A | | 8/1996 | Hotvet | |
| 5,631,965 | A | | 5/1997 | Chang | |
| 5,675,658 | A | | 10/1997 | Brittain | |
| 5,701,355 | A | | 12/1997 | Brannan | |
| 5,870,483 | A | | 2/1999 | Wong | |
| 6,412,593 | B1 | * | 7/2002 | Jones | 181/129 |
| 6,463,157 | B1 | * | 10/2002 | May | 381/151 |
| 6,567,525 | B1 | * | 5/2003 | Sapiejewski | 381/71.6 |
| 6,574,345 | B1 | | 6/2003 | Huang | |
| 6,597,792 | B1 | | 7/2003 | Sapiejewski | |
| 6,631,279 | B2 | | 10/2003 | Rivera | |
| 6,704,428 | B1 | | 3/2004 | Wurtz | |
| 6,748,087 | B1 | * | 6/2004 | Jones | 381/71.6 |
| 6,801,629 | B2 | | 10/2004 | Brimhall | |
| 6,965,681 | B2 | | 11/2005 | Almqvist | |
| 6,970,571 | B2 | | 11/2005 | Knorr | |
| 7,245,735 | B2 | | 7/2007 | Han | |
| 7,308,106 | B2 | | 12/2007 | Vaudrey | |
| 7,327,850 | B2 | | 2/2008 | Crump | |
| 7,391,878 | B2 | | 6/2008 | Liao | |
| 7,664,282 | B2 | | 2/2010 | Urso | |
| 8,054,985 | B2 | | 11/2011 | Doty | |
| 2001/0046304 | A1 | | 11/2001 | Rast | |
| 2004/0125976 | A1 | | 7/2004 | Reneker | |
| 2007/0274529 | A1 | | 11/2007 | Nordin | |
| 2008/0011084 | A1 | | 1/2008 | Von Dach | |

FOREIGN PATENT DOCUMENTS

| | | | |
|---|---|---|---|
| EP | 0465971 | A2 | 1/1992 |
| EP | 0967592 | | 12/1999 |
| EP | 1629808 | A1 | 3/2006 |
| GB | 1160431 | A | 8/1969 |
| GB | 1289993 | | 9/1972 |
| GB | 2445984 | A | 7/2008 |
| WO | WO 87/04065 | | 7/1987 |
| WO | WO 91/07153 | | 5/1991 |
| WO | WO 96/08004 | | 3/1996 |
| WO | WO 97/28742 | A1 | 8/1997 |
| WO | WO 02/17838 | | 3/2002 |
| WO | WO 2005/051255 | | 6/2005 |
| WO | WO 2006/118514 | | 11/2006 |
| WO | WO 2008/099137 | | 8/2008 |
| WO | WO 2008/113822 | | 9/2008 |

* cited by examiner

EAR CUP WITH BONE CONDUCTION MICROPHONE

TECHNICAL FIELD

The present invention relates to an ear cup with a bone conduction microphone, and comprising a cup, a sealing ring which is dismountably secured on the cup and which is intended to sealingly abut against the wearer's head around the wearer's ear, and a microphone capsule for cooperation with the wearer's head immediately in front of the wearer's ear.

BACKGROUND ART

Ear cups or headsets of the above-mentioned type are previously known in the art. In them, the microphone capsule has been disposed interiorly in the sealing ring with the sound-sensitive surface immediately beneath the surface layer with which the sealing ring is provided. In technical terms, this construction functions satisfactorily.

Ear cups or headsets of the type under consideration here are often used for lengthy periods of time. This implies that the interior of the ear cup, and above all the sealing ring, becomes dirty often because of the sweat secreted by the wearer. For this reason, so-called hygienic inserts have been created which int. al. include the sealing ring and which must be replaced at regular intervals if a satisfactory level of hygiene in the ear cup is to be maintained.

In the prior art construction, it has also been necessary, in conjunction with replacement of the hygienic insert, to replace the microphone capsule, since this is disposed interiorly in the material of the sealing ring. This entails overly high costs in connection with the replacement of a hygienic insert.

PROBLEM STRUCTURE

The present invention has for its object to obviate the drawbacks inherent in the prior art technology. In particular, the present invention has for its object to realise an ear cup or headset with a bone conduction microphone where the bone conduction microphone does not need to be replaced in connection with replacement of the hygienic insert. Further, the present invention has for its object to realise an ear cup or headset which, despite the employment of a bone conduction microphone, is simple in manufacture and which makes for simple replacement of the hygienic insert.

SOLUTION

The objects forming the basis of the present invention will be attained if the ear cup or headset mentioned by way of introduction is characterised in that the microphone capsule is disposed in a retainer body which has an anchorage portion for anchorage interiorly in the ear cup, and that the retainer body has a position of use where it is located between the sealing ring and the wearer's head, and the retainer body is also wholly or partly pressed into the sealing ring when the ear cup is worn pressed against the head of the wearer.

BRIEF DESCRIPTION OF THE ACCOMPANYING DRAWINGS

The present invention will now be described in greater detail hereinbelow with reference to the accompanying Drawings. In the accompanying Drawings.

DESCRIPTION OF PREFERRED EMBODIMENT

Figure 1:
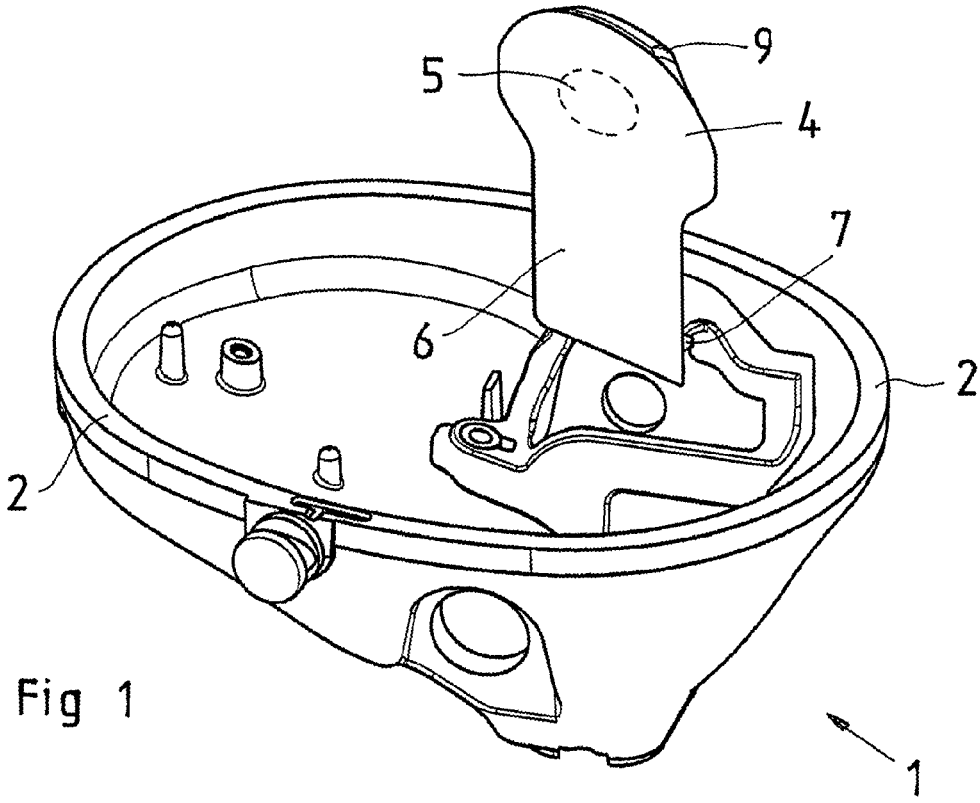
FIG. 1 shows an empty ear cup without sealing ring, but with a retainer body with anchorage portion mounted therein.

FIG. 1 shows an empty ear cup 1 included in a complete ear cup unit or headset. The ear cup 1 is as a rule manufactured from plastic and has interiorly a number of parts for the securing of electronics, absorbents and the like. The ear cup 1 has an edge 2 which is designed for securing a sealing ring 3 (see FIG. 2). Thus far, the ear cup 1 as described in the foregoing is to be considered as fully conventional. This entails, on the one hand, that the sealing ring may readily be replaced in conjunction with the replacement of hygienic insert and, on the other hand, that the sealing ring 3 consists of a core of elastically yieldable material, as a rule a foamed material, and an outer casing or envelope which encloses the elastic foamed material. On use of the ear cup, this is held pressed against the head of the wearer and around the wearer's ears, so that satisfactory sealing is obtained between the sealing ring and the wearer's head.

It is also conceivable that the sealing ring 3 includes a liquid or a gel.

It will be apparent from FIG. 1 that, interiorly in the ear cup 1, there is secured a retainer body 4 for a microphone capsule 5 intimated by broken lines. The retainer body 4 has an anchorage portion 6 which, at its lower end in FIG. 1, has an angled projection 7 directed away from the observer of the Drawing and by means of which the retainer body and the anchorage portion are secured interiorly in the ear cup 1.

Preferably, the retainer body 4, the anchorage portion 6 and the projection 7 are of one piece manufacture from an elastically flexible material, for example rubber. The anchorage portion 6 is of a thickness which makes it readily flexible from the straight upright position illustrated in FIG. 1 to the position of use illustrated in FIG. 2 where the one side of the retainer body 4 abuts against the sealing ring and its other side abuts against the wearer's head.

Figure 2:
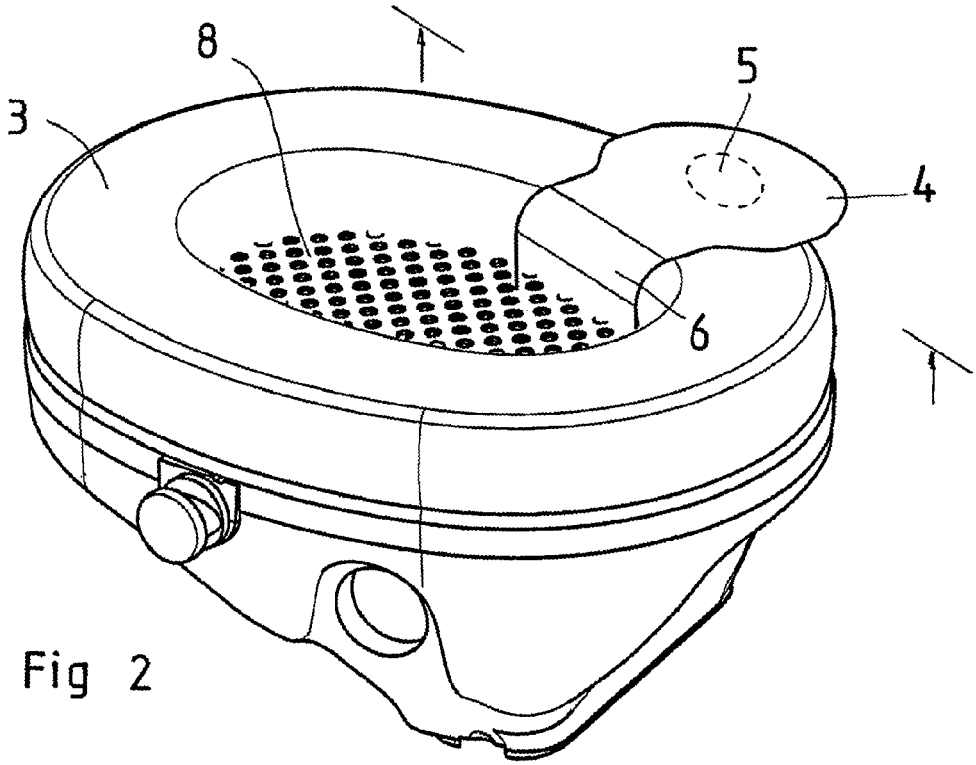
FIG. 2 shows the ear cup according to FIG. 1, now provided with fittings and sealing ring, with the retainer body in a position of use.

Alternatively, the anchorage portion 6 may, already at manufacture, be of a configuration which entails that the retainer body 4 assumes its position of use and thus abuts against the sealing ring 3, hence as shown in FIG. 2. On replacement of hygienic insert, the anchorage portion 6 is, in this alternative, bent to the position illustrated in FIG. 1.

It will readily be perceived that, with the retainer body 4 and the anchorage portion 6 in the position illustrated in FIG. 1, the sealing ring 3 may easily be replaced, if required. In addition, there is ready access to those parts as are disposed interiorly in the ear cup, for example the absorbent 8 illustrated in FIG. 2. The hygienic insert mentioned by way of introduction includes at least the sealing ring 3 and preferably also the absorbent 8.

It should be emphasised that, with the practical application of the present invention, it is sufficient if the sealing ring 3 is of economical, easily replaceable standard type.

The side of the retainer body 4 and anchorage portion 6 facing towards the observer of FIG. 1 is, in the position according to FIG. 1, substantially planar. This implies that, in the position of use according to FIG. 2, the retainer body 4 displays a substantially planar surface for abutment and sealing against the wearer's head immediately in front of the wearer's ear. However, in this position of use, the anchorage portion 6 is bent, as is clearly apparent from FIG. 2.

It will be at least partly apparent from FIG. 1 that the retainer body 4 has, in this Figure, an arched rear surface 9 which, in the position of use according to FIG. 2, is intended to abut against the sealing ring 3 and be wholly or partly impressed therein under the action of the forces that are generated when the complete ear cup or headset is worn on the wearer's head and where, for instance, it is held in position with the aid of a crown strap or the like. Other alternatives are also conceivable. Thus, the ear cups may have a neck strap or be secured in or on a helmet. How the ear cups are held against the head of the wearer is immaterial to the present invention as long as the correct abutment pressure and correct positioning can be ensured.

Figure 3:
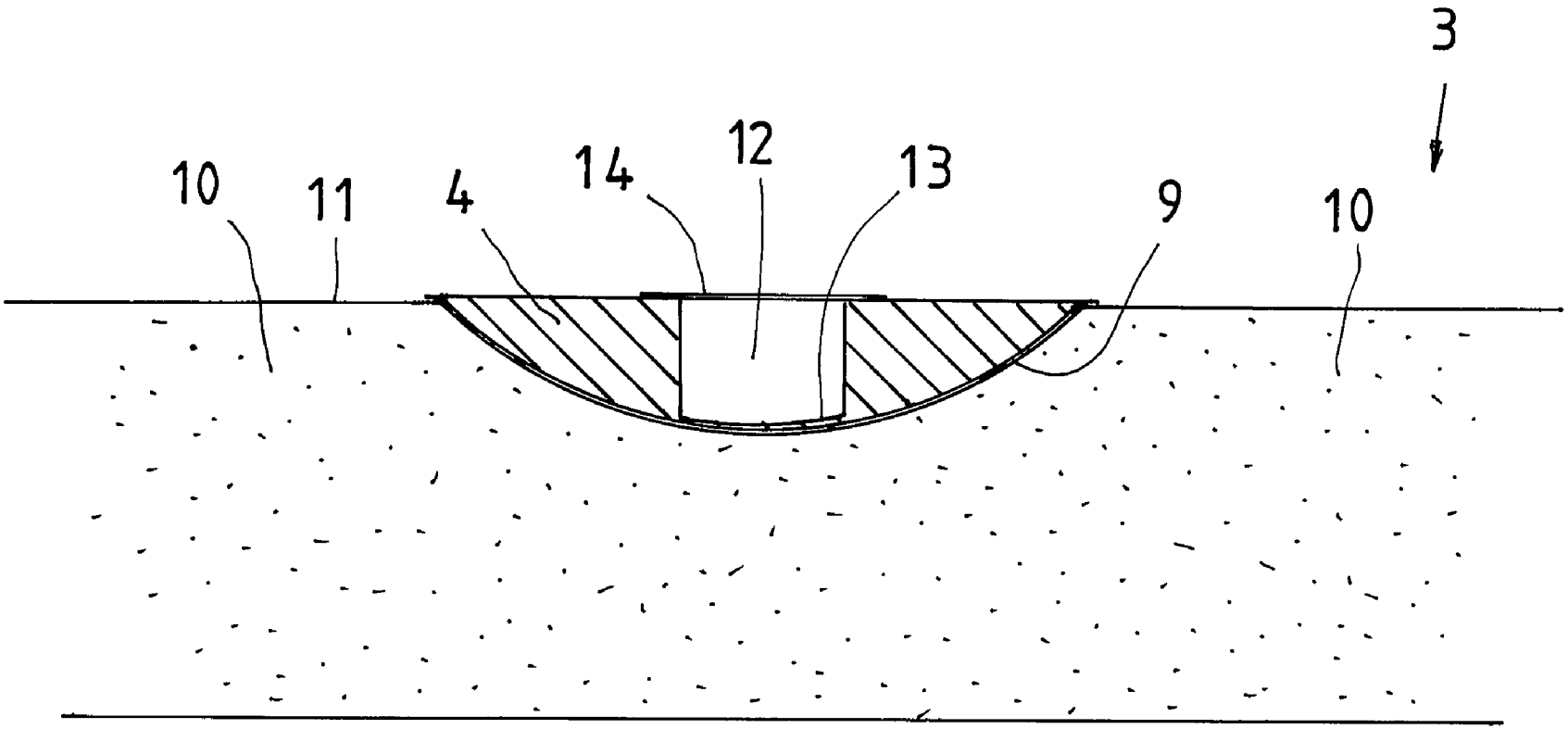
FIG. 3 is a cross section through the sealing ring taken along the section marking in FIG. 2.

It will be clearly apparent from FIG. 3 that the arched surface 9 of the retainer body 4 which is the rear surface in FIG. 1 is wholly impressed in the sealing ring 3. This entails that, in the transitional zone between the retainer body 4 and the sealing ring 3, a completely satisfactory can be attained so that the sound damping effect of the ear cup is thereby not jeopardised.

In a traditional manner, the sealing ring 3 has a filling of an elastically deformable foamed material 10 and a foil-thin outer casing or envelope 11 which is readily flexible.

The retainer body 4 has a recess 12 in which the microphone capsule 5 is disposed. The recess 12 has a bottom wall 13 which, in the position of use, is turned to face towards the sealing ring 3 and which consists of a thin, readily flexible material, as a rule rubber, since the retainer body 4 can suitably be manufactured from this material in its entirety. The recess 12 and the microphone capsule 5 are, in a direction in towards the user's head, covered by a thin partition 14 which consists of a readily flexible, possibly elastic material. The depth of the recess 12 is adapted in such a manner that the microphone capsule exactly has room between the partition 14 and the bottom wall 13. This implies that, when the retainer body 4 is impressed into the sealing 3, as shown in FIG. 3, forces created by an elastic compression of the foamed material 10 of the sealing ring 3 will, via the bottom wall 13, press the microphone capsule against the partition 14 and this latter against the user's head. As a result, a good sound conduction will be attained from the user's head via the partition to the microphone capsule 5.

According to the present invention, the distance between the partition 14 and the bottom wall 13 may be greater than the extent of the microphone capsule in the same direction. In this alternative, use is made in the recess 12 of a spacer element which fills out the remaining space in the recess 12. This spacer element guarantees that the microphone capsule will have the correct abutment pressure or conduct the sound from the user's head to the microphone capsule. The spacer element may consist of felt, a foamed material or rubber.

It should be emphasised that the microphone capsule 5 is completely separate and discrete from hard or rigid components in the ear cup and is only affected by the above-mentioned forces created by the elasticity of the foamed material.

In order to realise good sealing between the retainer body 4 and the sealing ring 3, it is important that the arched, rear surface 9 of the retainer body in a direction out towards the periphery of the retainer body gradually merges into a thin edge portion which affords fully satisfactory sealing against the sealing ring 3 when the retainer body is impressed therein. In other words, the retainer body 4 has a configuration which implies that it is attenuated outwards in a direction towards the periphery so as not to form any stepped transition in the joint to the sealing ring 3.

It will be apparent from FIG. 3 that the recess 12, and thereby also the microphone capsule, is disposed in a central region of the retainer body 4, i.e. in that area where the thickness of the retainer body is at its greatest.

What is claimed is:

1. An ear cup with a bone conduction microphone, and comprising: a cup, a sealing ring which is dismountable and secured on the cup and which is intended to form a seal against the wearer's head around the wearer's ear, and a microphone capsule for cooperation with the wearer's head immediately in front of the wearer's ear, wherein the microphone capsule is disposed in a retainer body which has an anchorage portion for anchorage interiorly in the ear cup, and that the retainer body has a position of use where it is located between the sealing ring and the wearer's head, and the retainer body is also wholly or partly pressed into the sealing ring when the ear cup is worn pressed against the head of the wearer.

2. The ear cup as claimed in claim 1, wherein the retainer body has a recess in which the microphone capsule is disposed, and that the microphone capsule and the side of the recess facing towards the wearer in the position of use are covered by a foil-thin, flexible partition.

3. The ear cup as claimed in claim 2, wherein the distance between the inside of the partition and the inside of the bottom wall substantially corresponds to the extent of the microphone capsule in the same direction.

4. The ear cup as claimed in claim 1, wherein the retainer body has a recess in which the microphone capsule is disposed, and that the recess has a bottom wall which, in the position of use, is turned to face towards the sealing ring and which consists of a foil-thin, flexible material.

5. The ear cup as claimed in any of claims 1 to 3, wherein the retainer body has its surface facing towards the sealing ring, in the position of use, arched with a central portion outwardly bulging in the sealing ring and thin peripheral portions.

6. The ear cup as claimed in claim 5, wherein the recess with the microphone capsule is disposed centrally in the outwardly bulging central portion.

7. The ear cup as claimed in any of claims 1 to 3, wherein the microphone capsule is, in the position of use, separate and discrete from all hard or rigid parts of the cup and that it is pressed against the wearer's head under the action of forces created by elastic deformation of the material of the sealing ring.

* * * * *

UNITED STATES PATENT AND TRADEMARK OFFICE

CERTIFICATE OF CORRECTION

PATENT NO. : 8,130,985 B2
APPLICATION NO. : 12/303497
DATED : March 6, 2012
INVENTOR(S) : Niklas Emilsson It is certified that error appears in the above-identified patent and that said Letters Patent is hereby corrected as shown below:

Title page item [74]

Delete "Vilet" and insert -- "Vliet" -- therefor.

Signed and Sealed this
Twenty-ninth Day of January, 2013

David J. Kappos

David J. Kappos
*Director of the United States Patent and Trademark Office*